US006085827A

United States Patent [19]

Hugo

[11] Patent Number: 6,085,827

[45] Date of Patent: Jul. 11, 2000

[54] METHOD FOR THE DIRECTED SOLIDIFICATION OF MOLTEN METAL AND A CASTING APPARATUS FOR THE PRACTICE THEREOF

[75] Inventor: Franz Hugo, Aschaffenburg, Germany

[73] Assignee: Leybold Durferrit GmbH, Cologne, Germany

[21] Appl. No.: 08/152,523

[22] Filed: Nov. 16, 1993

[30] Foreign Application Priority Data

Jun. 30, 1993 [DE] Germany ..... 43 216 40

[51] Int. Cl.[7] ..... B22D 27/04

[52] U.S. Cl. ..... 164/122.1; 164/348

[58] Field of Search ..... 164/122.1, 122.2, 164/348

[56] References Cited

U.S. PATENT DOCUMENTS

| | | | |
|---|---|---|---|
| 3,635,279 | 1/1972 | Matsunaga et al. | 164/501 |
| 3,763,926 | 10/1973 | Tschinkel et al. | 164/338.1 |
| 4,108,236 | 8/1978 | Salkeld | 164/338.1 |
| 4,540,550 | 9/1985 | Gaida et al. | 422/109 |

FOREIGN PATENT DOCUMENTS

| | | |
|---|---|---|
| 010538 | 4/1980 | European Pat. Off. . |
| 2242111 | 3/1973 | Germany . |
| 2735928 | 2/1978 | Germany . |
| 4216870 | 1/1993 | Germany . |

*Primary Examiner*—Kuang Y. Lin
*Attorney, Agent, or Firm*—Fulbright & Jaworski, LLP

[57] ABSTRACT

A casting apparatus has within a heating chamber (6) and a mold (5) which can be removed from the heating chamber into a molten quenching metal (10) disposed underneath it. As a thermal barrier between the heating chamber (6) and the quenching metal (10), a thermal insulating layer (13) floating on the molten quenching metal (10) is provided, through which the mold (5) plunges into the molten quenching metal (10).

14 Claims, 4 Drawing Sheets

23
14
5
6
13
26
10
17
18
8
22
21
1
20
19
2

METHOD FOR THE DIRECTED SOLIDIFICATION OF MOLTEN METAL AND A CASTING APPARATUS FOR THE PRACTICE THEREOF

BACKGROUND OF THE INVENTION

The invention relates to a method for the directed solidification of a molten metal, such as nickel for example, poured into a mold, by moving the mold out of a heating chamber and immersing the mold into a molten metal bath of lower melting point than the molten metal in the mold and serving as a quenching metal, aluminum for example. The invention furthermore relates to a casting apparatus for the practice of this method.

Such a method and such casting apparatus are subject matter of U.S. Pat. No. 4,108,236. The immersion of the mold in the molten quenching metal serves, by means of an intense axial heat flow as the casting hardens in the mold, to achieve a solid-liquid zone of the least possible depth and a very flat phase boundary between solid and liquid transversely of the main length of the casting, so that the crystals will grow axially in the casting. Directing in this manner requires keeping the radial loss of heat by radiation above the molten quenching metal as low as possible. For this purpose, in the known casting apparatus, a heat barrier generally known as a baffle is provided on the bottom of the melting chamber and is directed at the mold. In addition, a separating plate of a thermal insulating material floats on the quenching metal and has an opening for immersing the mold into the quenching metal. The thermal insulation is only imperfect, especially when the castings have several downwardly directed parts, since then the baffle and the separating plate cannot reach the areas between these parts. Aside from this, there still remains a gap between the mold and the baffle through which heat is radiated away.

U.S. Pat. No. 3,635,279 shows a container for immersion of a mold having a molten metal that is to be cooled, with a quenching melt whose surface is covered with a thermal insulating layer. This layer has the purpose of preventing any oxidation or excessively great cooling of the quenching melt. Upon its immersion into the quenching melt the mold penetrates this thermal insulating layer. It is not, however, moved out of a heating chamber.

In a process of this kind, DE-B-22 42 111 (to which U.S. Pat. No. 3,763,926 corresponds) discloses providing the surface of the quenching melt so closely beneath the heating chamber that the quenching plate of the mold dips at least partially into the quenching melt before the mold is submerged. Thus the quenching plate is cooled just when the mold is filled with the quenching melt, so that it exercises an especially good quenching action. For the prevention of heat losses between the bottom end of the heating chamber and the mold, a heat shield is provided.

SUMMARY OF THE INVENTION

The invention is addressed to the problem of improving a method of the kind described above so that, as the castings solidify, a very steep temperature gradient can be achieved together with a very low radial heat flow. Furthermore, a casting apparatus for the practice of this method is to be created.

The first problem is solved in accordance with the invention in that, for sealing off between the heating chamber and the mold, a floating thermal insulating layer consisting of a material capable of flowing is placed on the quenching melt, and before the mold penetrates the thermal insulating layer and dips into the quenching melt, the heating chamber or the quenching melt is moved to the extent that the heating chamber touches the thermal insulating layer or dips into it.

By means of such a floating thermal insulating layer reaching up against the heating chamber, an optimal separation is achieved between the heating chamber and the quenching melt, so that the heat losses in the radial direction are negligibly low, and the formerly necessary, costly heat shield in this area can be dispensed with. Due to the perfect sealing on all sides, an optimum axial flow of heat from the casting to the molten quenching metal takes place. The result is an improvement of the metallurgical properties of the castings. Furthermore, castings of complex shape or a plurality of castings can be poured simultaneously and then solidified because the thermal insulating layer always follows the contours of the mold and always lies against it sealingly. A higher productivity is also achieved as a result of the thermal insulation layer, because the solidification can take place faster than it can in the state of the art.

The thermal insulating layer can be produced at very low cost with conventional means, if solids are used in forming it which have a surface that is not wettable by the quenching metal. Granules of graphite, ceramic or aluminum oxide are suitable with a coating that prevents wetting. The coating consists preferably of boron nitrite. It is also possible to use uncoated solids of boron nitrite or spherules of $SiAlO_2N$.

The method according to the invention can be adapted very simply to various requirements if the metallurgical properties of the castings are influenced by varying the thickness of the thermal insulation layer.

On account of the low heat losses and the good cooling effect as a result of the optical separation, a mold without a cooling plate can be used.

The second problem, namely the creation of a casting apparatus for the practice of the method, is solved according to the invention by the fact that the thermal barrier is a thermal insulating layer of a material capable of flowing, afloat on the quenching metal, and reaching at least to the bottom edge of the heating chamber.

Such a casting apparatus is of simpler construction than the formerly known casting apparatus, because it does not require complex thermal insulation on the bottom of the heating chamber. Nevertheless the operation of the casting apparatus is qualitatively better, because when the mold is immersed into the molten quenching metal through the floating thermal insulating layer a complete blocking of the heat is produced on all sides, even in the case of complex castings. The apparatus according to the invention makes it possible to perform either the process of the invention with the molten quenching metal and the thermal insulating layer or conventional DS-SC processes in the same apparatus.

The mold is preferably supported on a holding frame which can be lowered, and which grasps the heating chamber on its bottom and is configured for immersion into the crucible holding the quenching melt by lowering the holding frame. Such a holding frame makes it possible to close the heating chamber completely on the top, because no mold holder lowering the mold from above needs to enter into the melting chamber. The complete sealing of the heating chamber on its top, which is made possible by the invention, also prevents heat loss.

The casting apparatus is given an especially simple configuration if the crucible containing the quenching metal is disposed within a vertically driven elevator chamber, which bears the holding frame on its top.

The optical seal between the quenching metal and the bottom of the heating chamber can be achieved in a simple manner before the directed solidification begins, if the crucible is likewise disposed for vertical movement relative to this elevator chamber.

The ability to raise and lower the crucible relative to the elevator chamber can be realized in various ways. One simple embodiment consists of a boom reaching through a slot into the heating chamber, which can be raised and lowered by means of a vertical drive means in the form of a spindle drive.

To achieve the vertical drive, a commercial component can be used if, according to another development of the invention, the crucible is disposed on a boom of a carriage that can be raised and lowered on a guiding column and the carriage is driven vertically by means of the cable of a windlass having a hand crank disposed outside of the vacuum chamber of the casting apparatus.

In the case of crucibles of small cross section, when the mold is immersed into the crucible containing the quenching metal, the level of the latter is raised by its displacement by the mold, so that quenching metal may rise too far into the heating chamber. This can be prevented in a simple manner according to an especially advantageous further development of the invention wherein the quenching metal crucible has a spillway for the quenching metal in a side chamber separate from the crucible part containing the quenching metal, which determines the maximum fill level. The invention admits of numerous embodiments. For the further clarification of its basic principle two embodiments thereof and one modification of the crucible for the quenching melt are represented in the drawing and described herewith.

DETAILED DESCRIPTION OF THE PREFERRED EMBODIMENT

Figure 1:
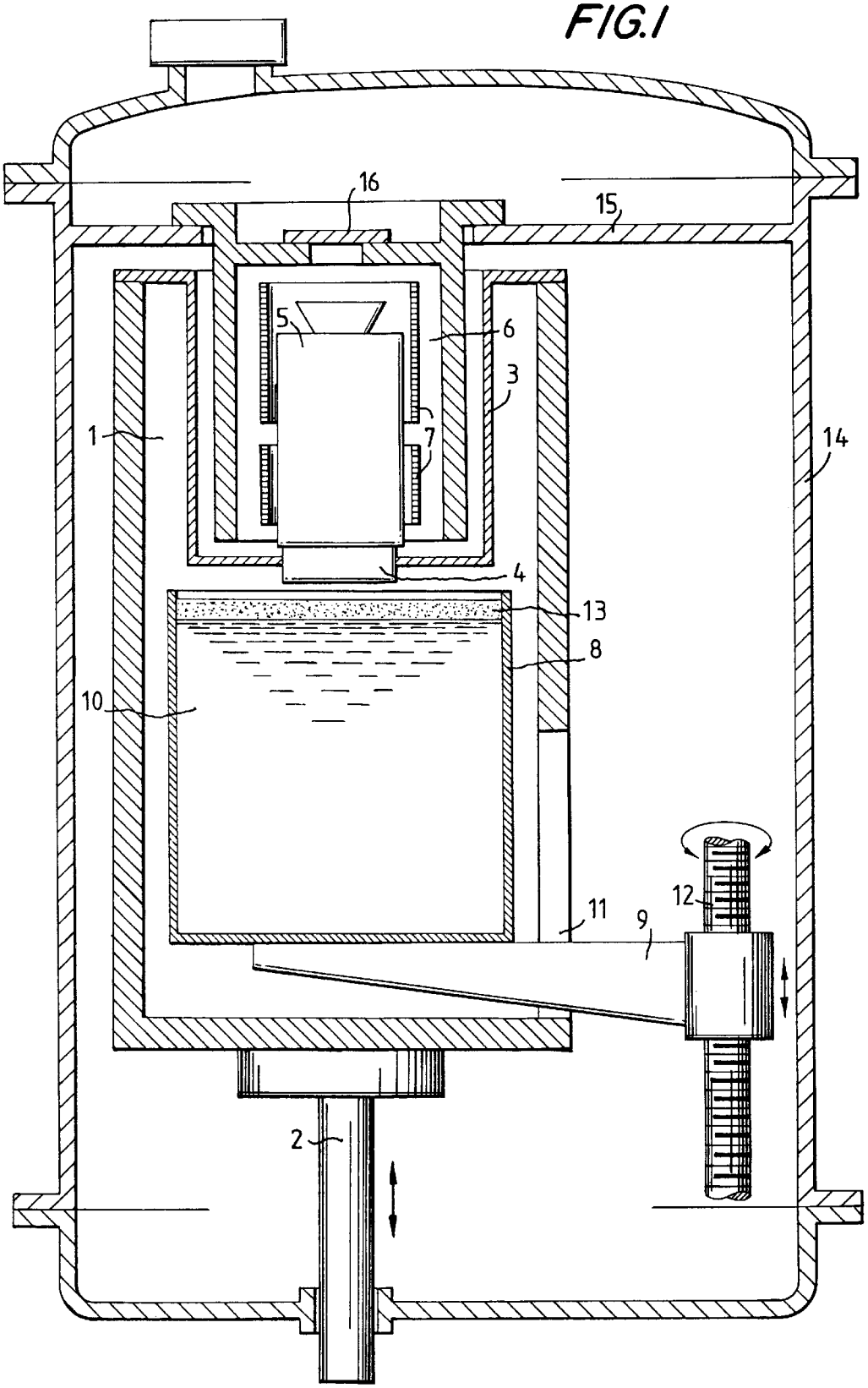
FIG. 1 a schematic longitudinal section through a casting apparatus with a mold placed into a melting chamber, FIG. 2 a section corresponding to FIG. 1 with the mold partially removed from the melting chamber and entering a molten quenching metal, FIG. 3 a longitudinal section through a second embodiment of the casting apparatus, FIG. 4 a longitudinal section through a second embodiment of a crucible for the quenching metal.

FIG. 1 shows an elevator chamber 1 which is mounted on a plunger 2 and can be moved up or down by moving the plunger 2. A mold holding frame 3 supported on the lifting chamber 1 reaches into the lifting chamber 1, and can be a basket-like structure made of graphite. On this mold holding frame 3 a cooling plate 4 is supported which forms the bottom of a mold 5. In the casting position shown, the mold 5 has been raised all the way into a heating chamber 6 which contains electrical heating elements 7 annularly surrounding the mold 5.

Underneath the heating chamber 6 a crucible 8 is mounted on a boom and contains a molten quenching metal 10. The boom 9 runs out through a slot 11 in the lifting chamber 1 and can be raised and lowered on a vertical guide 12. Important to the invention is a thermal insulating layer 13 consisting, for example, of aluminum oxide in the form of powder or granules, and floating on the molten quenching metal 10.

Figure 2:
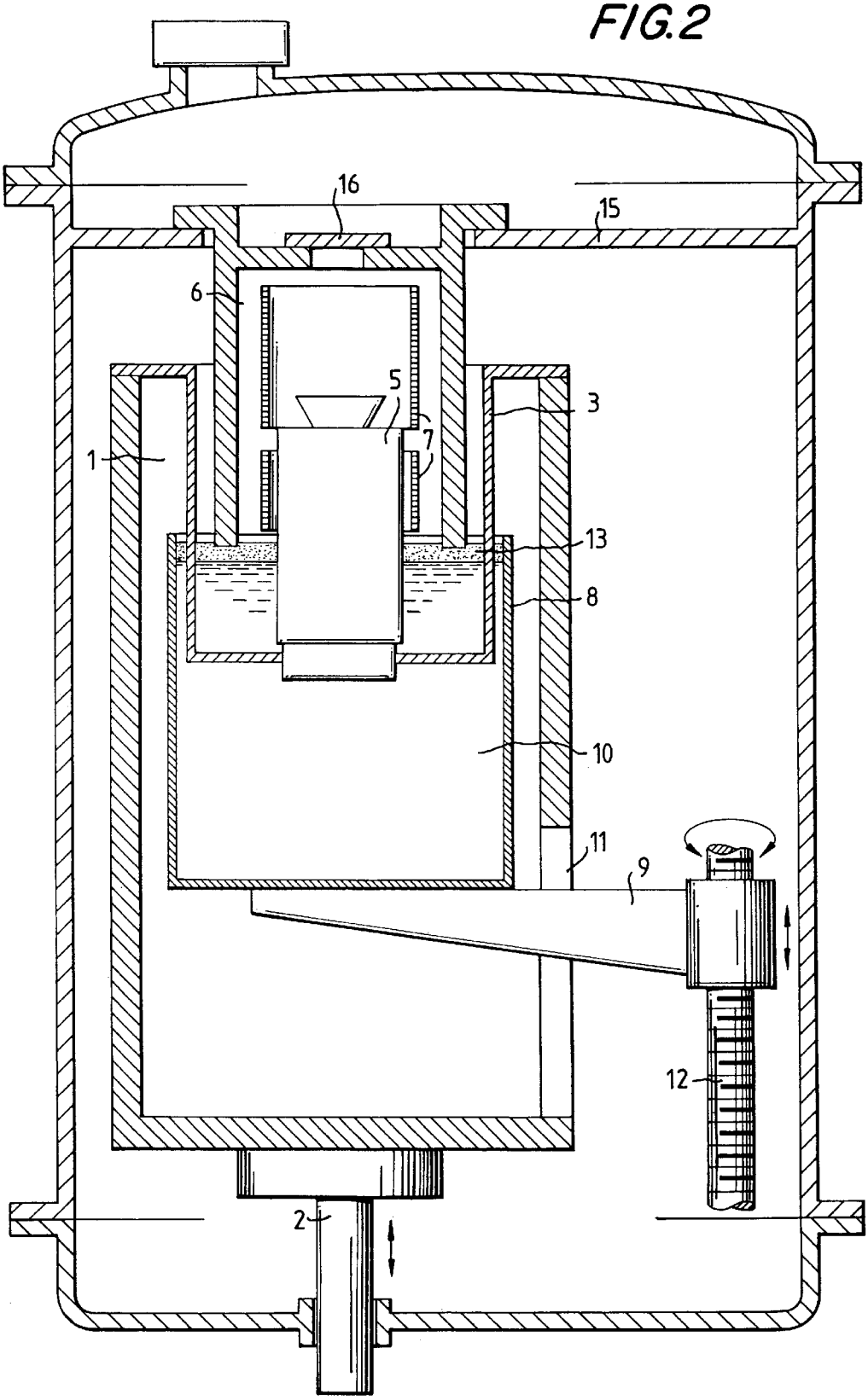

When the mold 5 is filled with molten metal and it is desired to begin the directed solidification, then first the crucible 8 containing the molten quenching metal 10 is raised up by running the boom 9 up on the vertical guide 12 until the bottom edge of the heating chamber 6 dips slightly into the thermal insulating layer 13, producing an optical cut-off between the interior of the heating chamber 6 and the quenching chamber, i.e., the molten quenching metal 10. Then the plunger 2 begins to be lowered. This lowers the elevator chamber 1 with the mold holding frame 3, so that the mold increasingly penetrates the thermal insulating layer 13 and becomes immersed in the molten quenching metal 10, which is represented in FIG. 2. This downward movement of the elevator chamber 1 is continued until the mold 5 is completely immersed in the molten quenching metal 10 and the casting in it is thereby solidified.

In FIGS. 1 and 2 it is additionally shown that the entire casting apparatus is disposed in a conventional manner in a vacuum chamber 14. The latter has an inwardly reaching, flange-like portion 15 on which the heating chamber 6 is supported. Not shown is a pivoting crucible disposed in the vacuum chamber 14, from which the molten metal can be poured into the mold 5 after lid 16 has been removed.

Figure 3:
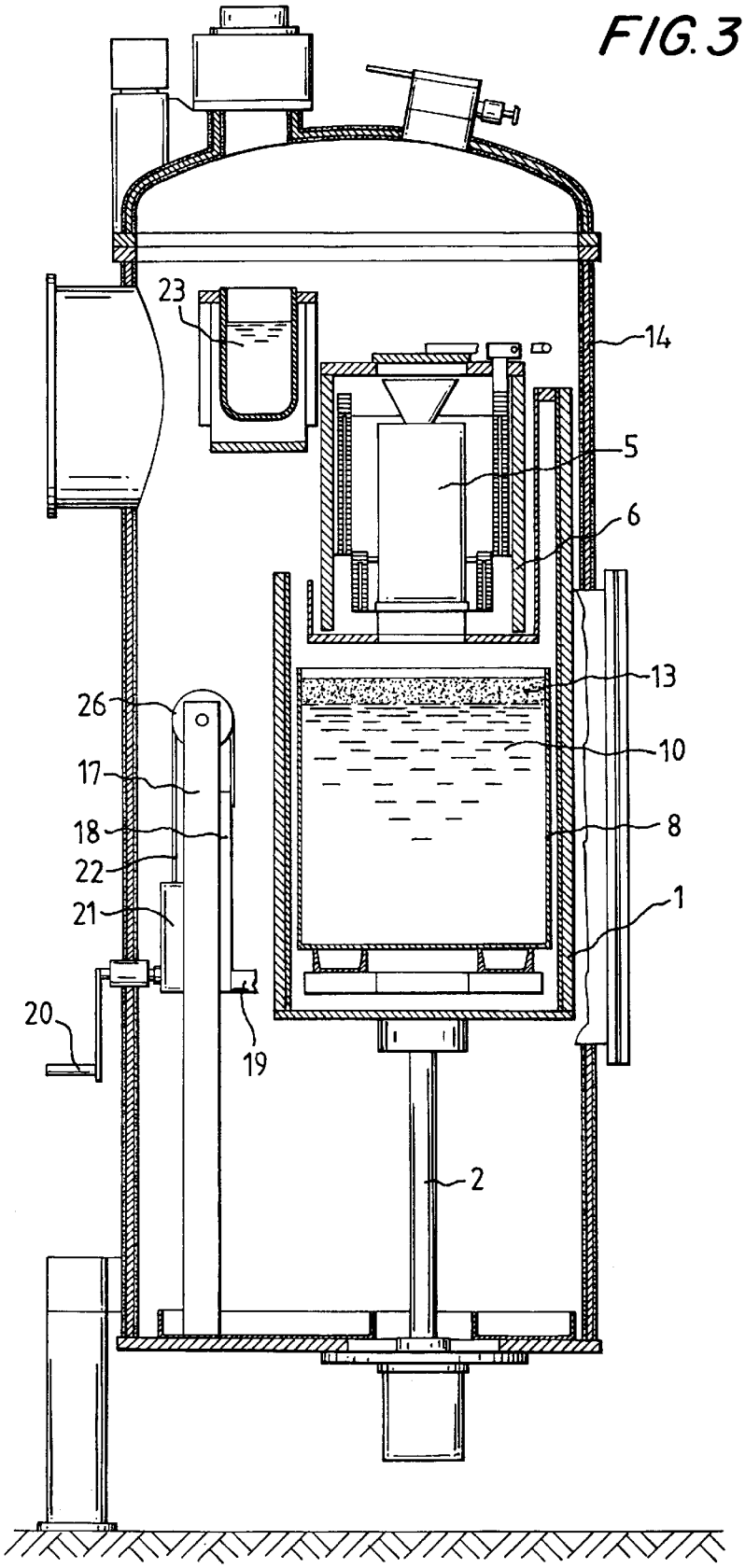

In the embodiment according to FIG. 3, an upright guiding column 17 is disposed in the vacuum chamber 14, and on it a carriage 18 is guided for raising and lowering. The carriage 18 has support 19, fragmentarily represented, on which the crucible 8 stands. A hand crank 20 serves for raising and lowering the carriage 18 and operates a windlass 21 from which a cable 22 runs over a pulley 26 on the column 17 to the carrier 18. This arrangement makes it possible before lowering the mold 5 to raise the crucible 8 with the hand crank 20 to such an extent that the thermal insulating layer 13 contacts the bottom of the heating chamber 6 and thus produces an optical seal.

A pivoting crucible 23 serves for pouring the molten metal into the mold 5. The lifting chamber 1 is raised and lowered by means of the plunger 2 the same as in the embodiment of FIGS. 1 and 2.

Figure 4:
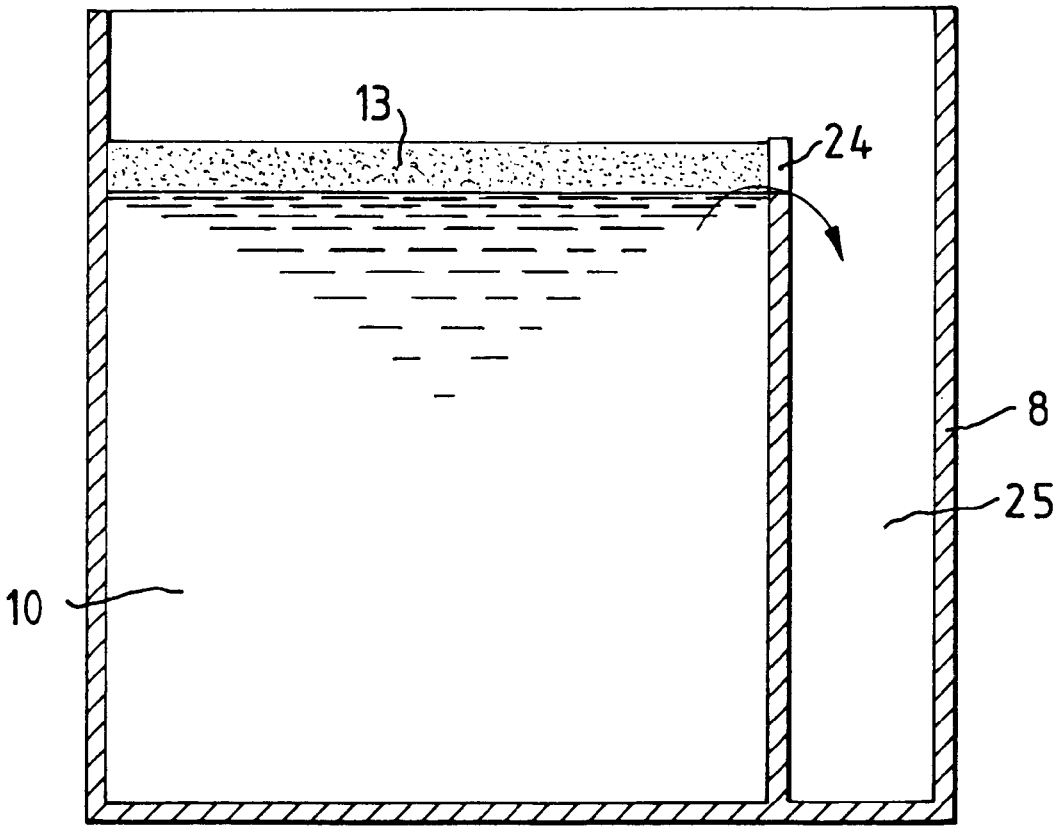

The crucible 8 shown in FIG. 4 differs from the one in the preceding figures in that it has a side chamber 25 in which the quenching metal 10 displaced when the mold is lowered into it can flow through a spillway 24. After the process of the invention has ended, the quenching metal solidified in this side chamber can be removed and put back into the crucible part which is intended for cooling the mold.

What is claimed is:

1. Method for the directed solidification of a molten metal, said method comprising providing said molten metal in a mold in a heating chamber having an open bottom, providing a molten bath of quenching metal below said heating chamber, said quenching metal having a lower melting point than said molten metal in said mold, providing a thermal insulating layer on said molten bath of quenching metal, moving said molten bath of quenching metal relative to said heating chamber so that said open bottom is closed by said thermal insulating layer, and subsequently, moving said mold out of said heating chamber, through said thermal insulating layer, and into said molten bath of quenching metal.

2. Method as in claim 1 wherein said thermal insulating layer comprises solid material that is not wettable by the quenching metal.

3. Method as in claim 2 wherein said thermal insulating layer comprises at least one of graphite, ceramic, or aluminum oxide and has a coating that prevents wetting.

4. Method as in claim 3 wherein said coating comprises boron nitrite.

5. Method as in claim 2 wherein said solid material comprises uncoated solids of boron nitrite.

6. Method as in claim 2 wherein said solid material comprises uncoated spherules of $SiAlO_2N$.

7. Method as in claim 1 wherein said thermal insulating layer has a thickness which is chosen to influence the metallurgical properties of the metal solidified in the mold.

8. Method as in claim 1 wherein said mold has a bottom formed by a cooling plate.

9. Apparatus for the directed solidification of a molten metal comprising:

a heating chamber having an open bottom, a crucible containing a molten quenching metal situated below said heating chamber, a thermal insulating layer floating on said quenching metal and in contact with the bottom of said heating chamber, a mold movable vertically from said heating chamber through said thermal insulating layer and into said quenching metal in said crucible, and a mold holding frame which is movable vertically, said holding frame being configured for immersion in said molten quenching metal, said bottom of said heating chamber limiting upward vertical movement of said holding frame.

10. Apparatus as in claim 9 further comprising a vertically movable lifting chamber having an upper end which bears said mold holding frame.

11. Apparatus as in claim 10 further comprising means for moving said crucible vertically in said lifting chamber.

12. Apparatus as in claim 11 wherein said means for moving said crucible vertically comprises an aperture in said lifting chamber, a boom extending through said aperture and supporting said crucible inside said lifting chamber, and a spindle drive outside said lifting chamber for moving said boom vertically.

13. Apparatus as in claim 11 wherein said means for moving said crucible vertically comprises a guide column, a carrier movable vertically on said guide column, said carrier being fixed to said crucible, and a windlass for moving said carrier vertically on said guide column.

14. Apparatus for the directed solidfication of a molten metal comprising:

a heating chamber having an open bottom, a crucible containing a molten quenching metal situated below said heating chamber, a thermal insulating layer floating on said quenching metal and in contact with the bottom of said heating chamber, a mold movable vertically from said heating chamber through said thermal insulating layer and into said quenching metal in said crucible, wherein said crucible comprises a main chamber containing said molten quenching metal, a side chamber separated from the main chamber, and a spillway connecting said main chamber to said side chamber so that said side chamber receives any overflow as said mold moves into said molten quenching material.

* * * * *

UNITED STATES PATENT AND TRADEMARK OFFICE

CERTIFICATE OF CORRECTION

PATENT NO. : 6, 085, 827

DATED : Jul. 11, 2000

INVENTOR(S) : Franz Hugo

It is certified that error appears in the above-identified patent and that said Letters Patent is hereby corrected as shown below:

In cover page, in the section entitled Assignee, change "Cologne" to - - Koeln - -.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*